US009377031B2

(12) United States Patent
Miyake

(10) Patent No.: US 9,377,031 B2
(45) Date of Patent: Jun. 28, 2016

(54) ACCUMULATOR

(71) Applicant: EAGLE INDUSTRY CO., LTD., Tokyo (JP)

(72) Inventor: Kuniaki Miyake, Fujisawa (JP)

(73) Assignee: Eagle Industry Co., Ltd. (JP)

( * ) Notice: Subject to any disclaimer, the term of this patent is extended or adjusted under 35 U.S.C. 154(b) by 8 days.

(21) Appl. No.: 14/366,225

(22) PCT Filed: May 17, 2013

(86) PCT No.: PCT/JP2013/063789
§ 371 (c)(1),
(2) Date: Jun. 17, 2014

(87) PCT Pub. No.: WO2014/002642
PCT Pub. Date: Jan. 3, 2014

(65) Prior Publication Data

US 2014/0332106 A1 Nov. 13, 2014

(30) Foreign Application Priority Data

Jun. 26, 2012 (JP) ..... 2012-142866

(51) Int. Cl.
*F15B 1/10* (2006.01)

(52) U.S. Cl.
CPC ..... *F15B 1/103* (2013.01); *F15B 2201/3153* (2013.01); *F15B 2201/41* (2013.01)

(58) Field of Classification Search
CPC ..... F15B 1/10; F15B 1/103
USPC ..... 138/30, 31
See application file for complete search history.

(56) References Cited

U.S. PATENT DOCUMENTS

| | | | | |
|---|---|---|---|---|
| 6,502,828 | B1 * | 1/2003 | Sasaki | 277/590 |
| 7,770,599 | B2 * | 8/2010 | Ota et al. | 138/31 |
| 2004/0056530 | A1 * | 3/2004 | Yuda | F15B 1/103 303/116.1 |
| 2007/0029710 | A1 | 2/2007 | Takeuchi et al. | |
| 2009/0133768 | A1 * | 5/2009 | Miyake et al. | 138/30 |

(Continued)

FOREIGN PATENT DOCUMENTS

| | | |
|---|---|---|
| CN | 2082330 U | 8/1991 |
| CN | 2160037 Y | 3/1994 |

(Continued)

OTHER PUBLICATIONS

Extended European Search Report for Application No. EP 13 80 9373 dated Jul. 9, 2015 (3 pages).

*Primary Examiner* — Paul R. Durand
*Assistant Examiner* — Vishal Pancholi
(74) *Attorney, Agent, or Firm* — Harness, Dickey & Pierce, P.L.C.

(57) ABSTRACT

In an accumulator having an accumulator housing which is provided with an oil port connected to a pressure piping of equipment, and an inner portion of the accumulator housing being sectioned into a gas chamber filling with gas and a fluid chamber communicating with the oil port by a bellows and a bellows cap, the bellows cap seals the fluid chamber by coming into contact with a seal on the basis of movement in a stroke in the case that a pressure of the pressure piping is decreased, and the seal is retained by a seal retaining portion which is provided in an inner peripheral side of the seal. In the accumulator, a seal diameter of the seal is set to be larger than an effective diameter of the bellows at a position where the seal comes into contact with the bellows cap.

2 Claims, 7 Drawing Sheets

(56) References Cited

U.S. PATENT DOCUMENTS

| | | | | |
|---|---|---|---|---|
| 2010/0108168 | A1* | 5/2010 | Ota et al. | 138/30 |
| 2010/0193059 | A1* | 8/2010 | Nakaoka et al. | 138/31 |
| 2012/0006438 | A1* | 1/2012 | Nakaoka et al. | 138/30 |

FOREIGN PATENT DOCUMENTS

| | | | |
|---|---|---|---|
| DE | 1 00 53 579 | A1 | 5/2002 |
| EP | 1308634 | A1 | 5/2003 |
| JP | 02141701 | U | 11/1990 |
| JP | 2519607 | B2 | 7/1996 |
| JP | 2002-242901 | A | 8/2002 |
| JP | 2003-156002 | A | 5/2003 |
| JP | 2005-098391 | A | 4/2005 |
| JP | 2005-163911 | A | 6/2005 |
| JP | 2009-275768 | A | 11/2009 |
| JP | 2010-048394 | A | 3/2010 |
| JP | 4550402 | B2 | 9/2010 |

* cited by examiner

ACCUMULATOR

CROSS-REFERENCE TO RELATED APPLICATIONS

This application is a U.S. National Stage Application of International Application No. PCT/JP2013/063789 filed on May 17, 2013, and published in Japanese as WO 2014/002642 A1 on Jan. 3, 2014. This application claims priority to Japanese Application No. 2012-142866 filed on Jun. 26, 2012. The disclosures of the above applications are incorporated herein by reference.

BACKGROUND OF THE INVENTION

1. Field of the Invention

The present invention relates to an accumulator which is used as a pressure accumulator or a pulsation pressure damping device. The accumulator according to the present invention is used, for example, in a hydraulic system for a motor vehicle or a hydraulic system for an industrial equipment.

2. Description of the Conventional Art

Conventionally, as shown in FIG. 6, there has been known an accumulator 51 structured such that an accumulator housing 52 is provided with an oil port 53 which is connected to a pressure piping (not shown) of equipment, an internal portion of the accumulator housing 52 is sectioned into a gas chamber 56 filling the gas, and a fluid chamber 57 communicating with the oil port 53, by a bellows 54 and a bellows cap 55, and the accumulator 51 is activated to accumulate pressure and damp pulsation pressure on the basis of movement of the bellows cap 55, and extension and contraction of the bellows 54 so that gas pressure and liquid pressure balance (Japanese Unexamined Patent Publication No. 2005-098391).

Further, the accumulator 51 is provided with a safety mechanism 61 which prevents the bellows 54 from being damaged due to the unbalance between the gas pressure and the liquid pressure in the case that the pressure of the fluid chamber 57 is decreased together with the pressure decrease of the pressure piping. In other words, in the case that the pressure of the pressure piping is extremely decreased due to the operation stop of the equipment, the liquid (oil) within the fluid chamber 57 is discharged little by little from the oil port 53, the bellows 54 is expanded little by little by the filled gas pressure according to the liquid discharge, and the bellows cap 55 comes into contact with a seal 62 which is installed in the inner surface of the housing 52 so as to form a so-called zero-down state. In the zero-down state, the fluid chamber 57 is occluded by the seal 62 (a spatial position closer to an outer peripheral side than the seal 62 among the fluid chamber 57 is occluded), a part of the liquid is trapped within the fluid chamber 57, and the pressure of the trapped liquid and the gas pressure of the gas chamber 56 are balanced. Therefore, the bellows 54 is inhibited from being damaged due to an excess stress applied to the bellows 54.

However, in the prior art mentioned above, there is a case that a lip 62*a* of the seal 62 is inverted and is pinched between the seal retaining portion 63 and the bellows cap 55 as shown in FIG. 7B, in place of the case that the seal 62 comes into contact with the bellows cap 55 in a normal attitude as shown in FIG. 7A. There is a case that the seal 62 is damaged for the reason of the pinching, and the safety mechanism 61 is not activated so as to make the bellows 54 be damaged.

SUMMARY OF THE INVENTION

Problem to be Solved by the Invention

The present invention is made by taking the above points into consideration, and an object of the present invention is to provide an accumulator which can inhibit a seal installed in an inner portion of a housing from being pinched between a seal retaining portion in an inner peripheral side and a bellows cap, thereby inhibiting the seal and the bellows from being damaged.

Means for Solving the Problem

In order to achieve the object mentioned above, an accumulator according to a first aspect of the present invention is an accumulator comprising:

an accumulator housing which is provided with an oil port connected to a pressure piping of equipment;

an inner portion of the accumulator housing being sectioned into a gas chamber filling with gas and a fluid chamber communicating with the oil port by a bellows and a bellows cap;

the bellows cap sealing the fluid chamber by coming into contact with a seal on the basis of movement in a stroke in the case that a pressure of the pressure piping is decreased; and the seal being retained by a seal retaining portion which is provided in an inner peripheral side of the seal, wherein a seal diameter of the seal is set to be larger than an effective diameter of the bellows at a position where the seal comes into contact with the bellows cap.

Further, an accumulator according to a second aspect of the present invention is the accumulator described in the first aspect, wherein the seal has a seal lip, and the seal lip is a seal lip having a tongue shape in its cross section or a triangular shape in its cross section.

According to the new knowledge of the inventors of the present invention, the generation of the pinching of the seal in the prior art is caused by the following reasons.

More specifically, in the case that the pressure of the pressure piping is decreased by the operation stop of the equipment, the liquid (the oil) within the fluid chamber is discharged little by little from the oil port, the bellows is expanded little by little due to the pressure of the filled gas according to this, and the bellows cap moves at a stroke in a direction in which the bellows cap comes close to the seal installed in the inner surface of the housing. Further, just before the bellows cap comes into contact with the seal, the flow directed to the oil port is generated in the liquid which is pushed away by the bellows cap moving at the stroke, and the seal is pressed by the flow. As a result, the seal is deformed, and the pinching is generated. Just before the bellows cap comes into contact with the seal, the distance between the seal retaining portion provided in the inner peripheral side of the seal and the bellows cap becomes narrower and the direction of the flow is unified. Accordingly, the seal is strongly pressed in a state in which the flow becomes stronger.

Further, according to the new knowledge of the inventors of the preset invention, just before the bellows cap comes into contact with the seal, a part of the liquid pushed away by the bellows cap moving at the stroke flows inward (inward in a diametrical direction) toward the oil port, the other part thereof inversely flows outward (outward in the diametrical direction) toward the fluid chamber, and it is found that a position which should be called as a divide of these two flows is a position of an effective diameter of the bellows. In other words, since the seal diameter (the diameter of the rip end) of the seal which is the position at which the seal comes into contact with the bellows cap is smaller than the effective diameter of the bellows in the prior art mentioned above, the seal is pressed by the inward flow so as to be deformed inward. As a result, the pinching is generated.

On the contrary, according to the present invention, since the seal diameter (the diameter of the lip end) of the seal which is the position at which the seal comes into contact with the bellows cap is set to be larger than the effective diameter of the bellows, the seal is not pressed by the inward flow, and even if the seal is pressed, the seal is not pressed by the inward flow but is pressed by the outward flow. Therefore, the seal is not deformed inward by being pressed by the inward flow. As a result, it is possible to inhibit the seal from being pinched between the seal retaining portion and the bellows cap. The effective diameter of the bellows is the same as the outer diameter of the piston in the case that the bellows is assumed as the piston pushing away the liquid (the oil) when the bellows achieves the action of pushing away the liquid (the oil) on the basis of expansion and contraction.

The operation and effect of the present invention is particularly significantly achieved in the seal provided with the seal lip, and the seal lip includes the seal lip having the tongue shaped cross section and the seal lip having the triangular shaped cross section. These seal lips conventionally have the risk that the seal lips are pinched between the seal retaining portion and the bellows cap so as to be damaged. However, according to the present invention, it is possible to inhibit the pinching from being generated in the seal lips.

Effect of the Invention

The present invention achieves the following effects.

More specifically, since the seal diameter of the seal is set to be larger than the effective diameter of the bellows as described above in the present invention, the seal is not deformed inward by being pressed by the inward flow of the liquid. Therefore, it is possible to inhibit the seal from being pinched between the seal retaining portion and the bellows cap by being deformed inward. As a result, it is possible to prevent the seal from being damaged, prevent the safety mechanism from not being activated, and prevent the bellows from being damaged.

DETAILED DESCRIPTION OF PREFERRED EMBODIMENTS

The following embodiments are included in the present invention.

(1) Purpose

In the accumulator arranged in the equipment, in the case that the operation of the equipment stops, the control fluid is discharged little by little. According to this, the bellows in the inner portion of the accumulator comes down little by little on the basis of the action of the internal gas and comes into contact with the seal. Just before the contact between the seal and the bellows, the seal lip may be reversed as shown in FIG. 6B due to the flow of the oil. If the zero-down state is established while keeping the reverse, the seal damage is generated, and there is a risk that the bellows is damaged.

(2) Construction

The lip diameter of the seal is set to be equal to or more than the inner diameter of the bellows, preferably set to be equal to or more than the effective diameter of the bellows.

The bellows may be formed as a hairpin bellows shape, a small-pitch bellows shape (peak R<trough R), or a shape having a reduced bellows inner diameter.

(3) Effect

By making the lip diameter of the seal equal to or more than the effective diameter of the bellows, the oil flow just before the contact between the seal and the bellows cap comes to the flow heading for the outer peripheral side of the bellows, and does not come to the flow generating the lip reverse.

Embodiments

Next, a description will be given of embodiments according to the present invention with reference to the accompanying drawings.

Figure 1:
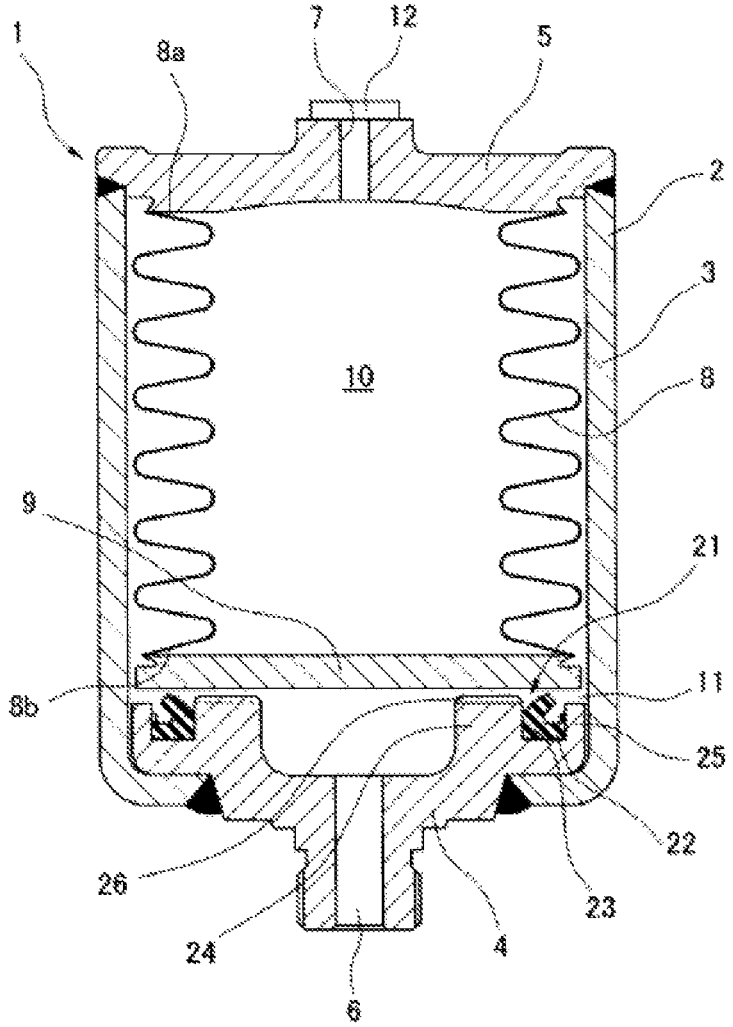
FIG. 1 is a cross sectional view of an accumulator according to an embodiment of the present invention.
Figure 2:
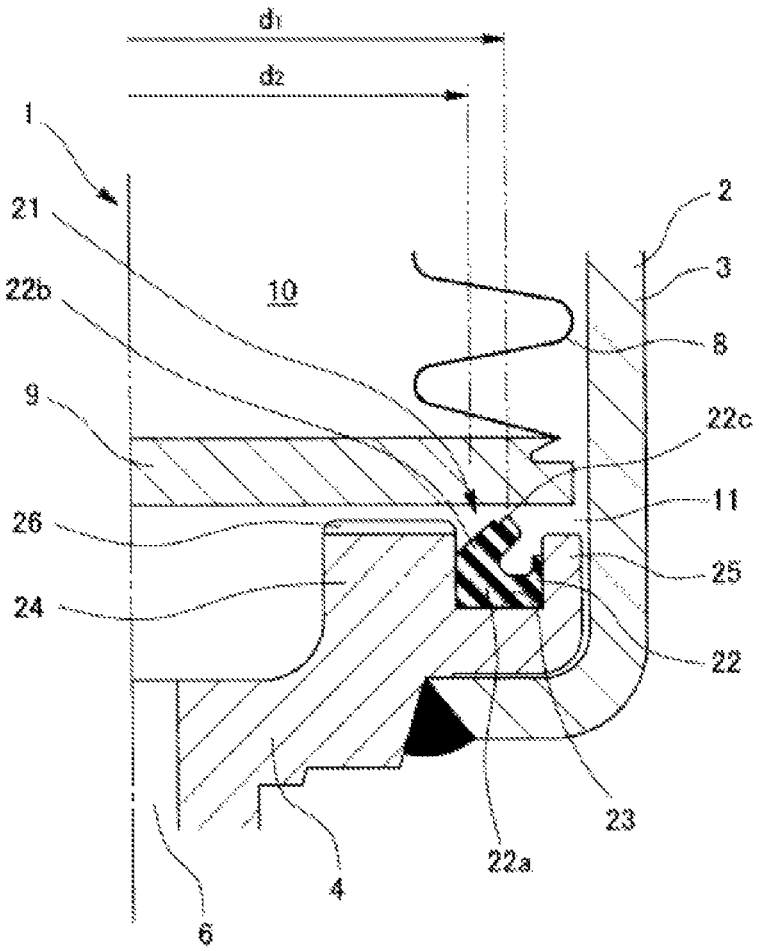
FIG. 2 is an enlarged view of a substantial part in FIG. 1.

FIG. 1 shows an accumulator 1 according to an embodiment of the present invention, and a substantial part there of is shown in an enlarged manner in FIG. 2. The accumulator 1 according to the embodiment is a metal bellows type accumulator employing a metal bellows as a bellows 8, and is structured as follows.

More specifically, there is provided an accumulator housing 2 which is provided with an oil port 6 connected to a pressure piping (not shown) in one end (a lower end in the drawing) and is provided with a gas filling port 7 in the other end (an upper end in the drawing), the bellows 8 and a bellows cap 9 are arranged in an inner portion of the housing 2, and an internal space of the housing 2 is sectioned into a gas chamber 12 which is filled with high-pressure gas (for example, nitrogen gas), and a fluid chamber 11 which is communicated with the oil port 6. The housing 2 is constructed by a combination of a cylindrical shell 3, an oil port member 4 and an end cover 5, the oil port member 4 being fixed (welded) to an one end opening portion (a lower end opening portion in the drawing) of the shell 3, and the end cover 5 being fixed (welded) to the other end opening portion (an upper end opening portion in the drawing) of the shell 3, however, a parts arrangement structure of the housing 2 is not particularly limited. For example, the shell 3 and the oil port member 4 may be integrated, and the shell 3 and the end cover 5 may be integrated. In any case, the end cover 5 or the corresponding part is provided with the gas filling port 7 for filling the gas chamber 10 with the gas, and the gas filling port 7 is closed by a gas plug 12 after being filled with the gas.

The bellows 8 is structured such that a fixed end (an upper end in the drawing) 8*a* is fixed (welded) to the end cover 5, and a discoid bellows cap 9 is fixed (welded) to a floating end (a lower end in the drawing) 8*b*. As a result, the accumulator 1 is formed as an internal gas type accumulator in which the gas chamber 10 is set in an inner peripheral side of the bellows 8 and the fluid chamber 11 is set in an outer peripheral side of the bellows 8.

Further, the accumulator 1 is provided with a safety mechanism (a pressure decreasing time safety mechanism) 21 for preventing the bellows 8 from being damaged due to unbalance between the gas pressure and the liquid pressure in the case that the pressure of the fluid chamber 11 is decreased together with the pressure decrease of the pressure piping.

The safety mechanism 21 is structured such that the bellows cap 9 comes into contact with a seal 22 which is installed to an inner surface of the housing 2, that is, an inner surface (an upper surface in the drawing) of the oil port member 4 in the case that the pressure of the fluid chamber 11 is decreased together with the pressure decrease of the pressure piping, thereby sealing the fluid chamber 11 and trapping the partial liquid (oil) in the fluid chamber 11, and is constructed as follows.

More specifically, as shown in an enlarged manner in FIG. 2, an annular seal installation groove 23 is provided in the inner surface of the housing 2, that is, the inner surface (the upper surface in the drawing) close to the oil port member 4, and an annular seal 22 is installed to the seal installation groove 23. A seal retaining portion (an inner peripheral side seal retaining portion) 24 having an annular projection shape is provided in an inner peripheral side of the installation groove 23, and a seal retaining portion (an outer peripheral side seal retaining portion) 25 having an annular projection shape is provided in an outer peripheral side of the installation groove 23. A height of the inner peripheral side seal retaining portion 24 is set to be larger than a height of the outer peripheral side seal retaining portion 25. As a result, the inner peripheral side seal retaining portion 24 also serves as a stopper which stops the inner peripheral side seal retaining portion 24 by the contact with the inner peripheral side seal retaining portion 24 in the case that the bellows cap 9 comes at a stroke in a direction coming close to the seal 22 (a stopper which defines a stroke end of the bellows cap 9). Further, a desired number of notch groove-like communication portions 26 are provided (a plurality of, for example, four notch groove-like communication portions are provided at a distance of 90 degrees circumferentially) in an end surface portion (an upper surface in the drawing) of the inner peripheral side seal retaining portion 24, in such a manner that the liquid can circulate from an inner peripheral side of the inner peripheral side seal retaining portion 24 to an outer peripheral side or inversely from the outer peripheral side to the inner peripheral side even in a state in which the bellows cap 9 comes into contact.

The seal 22 is formed into an annular shape by a predetermined rubber-like elastic material, and is integrally provided with an annular base portion 22*a* which is fixed to a groove bottom portion of the installation groove 23 and an annular seal lip 22*b* which has a tongue shaped cross section. The seal lip 22*b* is provided toward an outer side diagonally in a diametrical direction from the base portion 22*a* to a lip end 22*c*, and comes into contact with the bellows cap 9 in the lip end 22*c*. Therefore, the height of the seal in a free state is set to be somewhat larger than the height of the inner peripheral side seal retaining portion 24.

Further, as a characteristic structure of the present invention, a seal diameter of the seal 22 (a diameter of the lip end 22*c*) d1 is set to be equal to or larger than an effective diameter d2 of the bellows 8 (d1≥d2), the seal diameter d1 corresponding to a position at which the seal 22 comes into contact with the bellows cap 9. In the present embodiment, the seal diameter of the seal 22 (the diameter of the lip end 22*c*) d1 is set to be larger than the effective diameter d2 of the bellows 8 (d1>d2).

The effective diameter d2 of the bellows 8 can be determined according to the following expression (a).

Figure 3:
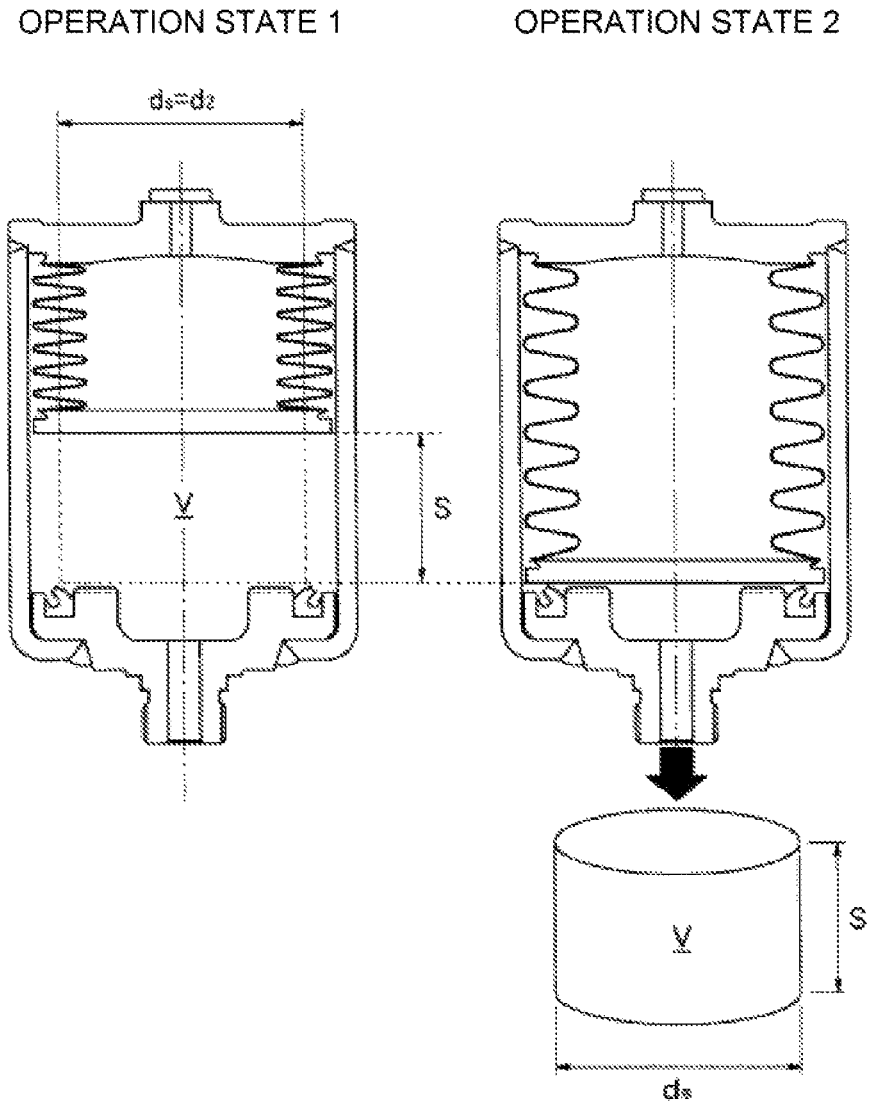
FIG. 3 is an explanatory view of an effective diameter of a bellows.

More specifically, S is set to a stroke of the bellows 8 from a state (an operation state 1) in which the accumulator 1 accumulates pressure, to a state (an operation state 2) in which the bellows 8 is extended due to the pressure decrease of the piping, as shown in FIG. 3. Further, V is set to a liquid amount (a discharge amount) of the liquid supplied to the piping from the accumulator 1, by the state change from the state (the operation state 1) in which the accumulator 1 accumulates the pressure to the state (the operation state 2) in which the bellows 8 is expanded due to the pressure decrease of the piping. In the case that a volumetric capacity of the discharge amount V is set to a volumetric capacity of a circular cylinder having a height S, a diameter ds of the circular cylinder is obtained by the following expression (π: circle ratio).

$$ds = \sqrt{\frac{4 \times V}{\pi \times S}} \quad \ldots (a)$$ Expression 1

The diameter ds is set to the effective diameter d2 of the bellows 8.

The accumulator 1 having the structure mentioned above is connected to the pressure piping of the equipment by the oil port 6, and in the case that the magnitude of the pressure within the pressure piping changes, the bellows cap 9 moves so that the gas pressure within the gas chamber 10 and the fluid pressure within the fluid chamber 11 balance, and the pressure accumulating action or the pulsation damping action is carried out by the expansion and contraction of the bellows 8.

Further, since the safety mechanism 21 is provided, the liquid (the oil) within the fluid chamber 11 is discharged little by little from the oil port 6 in the case that the pressure of the pressure piping is extremely decreased by the operation stop of the equipment. The bellows 8 is expanded little by little by the sealed gas pressure together with the pressure decrease, and the bellows cap 9 comes into contact with the lip end 22*c* of the seal 22 which is installed in the inner surface of the housing 2 so as to form a so-called zero-down state. Further, in the zero-down state, the fluid chamber 11 is occluded by the seal 22, the partial liquid is trapped within the fluid chamber 11, and the pressure of the trapped liquid and the gas pressure of the gas chamber 10 balance. Therefore, it is possible to inhibit the excessive stress from being applied to the bellows 8 and inhibit the bellows 8 form being damaged.

Further, just below the contact of the bellows cap 9 with the lip end 22*c* of the seal 22, a part of the liquid pushed away by the bellows cap 9 moving at the stroke flows toward the oil port 3 (inward flow), the other part thereof inversely flows toward the fluid chamber 11 (outward flow), and a divide of these two flows is a position of the effective diameter d2 of the bellows 8. However, in the accumulator 1, since the seal diameter of the seal 22 (the diameter of the lip end 22*c*) d1 is set to be larger than the effective diameter d2 of the bellows 8 (d1>d2), the seal lip 22*b* is not pushed by the inward flow but is pushed by the outward flow. Therefore, the seal lip 22*b* is not pushed by the inward flow so as to be deformed inward, and it is accordingly possible to inhibit the seal lip 22*b* from being pinched between the seal retaining portion 24 and the bellows cap 9. Accordingly, it is possible to prevent the seal 22 from being damaged by the pinching of the seal lip 22*b*, prevent the safety mechanism 21 from being activated, and prevent the bellows 8 from being damaged.

The following matters can be added to the embodiment mentioned above.

Figure 4:
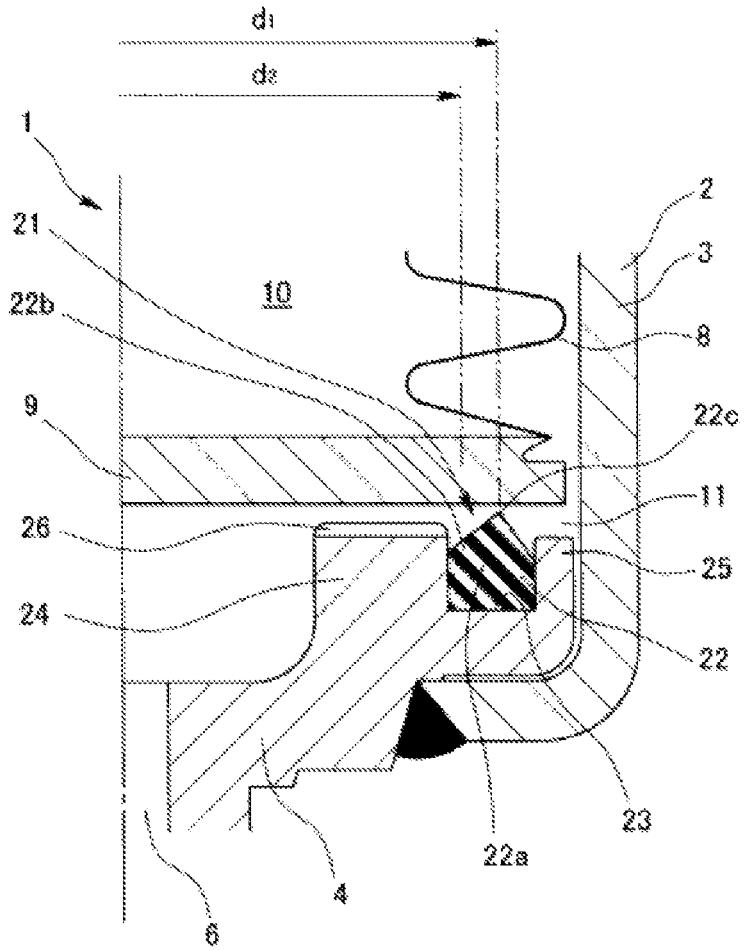
FIG. 4 is a cross sectional view of a substantial part of an accumulator according to the other embodiment of the present invention.

(1) In the embodiment mentioned above, the seal 22 is set to the seal which is provided with the seal lip 22*b* having the tongue shaped cross section, however, may be set to a seal which is provided with a seal lip having the other shape, for example, may be set to a seal which is provided with a seal lip 22*b* having a triangular cross section as shown in FIG. 4. In the seal provided with the seal lip having the other shape, according to the present invention, it is possible to inhibit the seal lip 22*b* from being pinched between the seal retaining portion 24 and the bellows cap 9 so as to be damaged. The seal lip 22*b* having the tongue shaped cross section is structured such as to have a directionality in a diametrical direction with regard to the sealing action on the basis of the diagonally directed provision of the seal lip 22*b* (the inclination in the same inclining direction of the inner peripheral surface and the outer peripheral surface of the seal lip 22*b*).

Figure 5A:
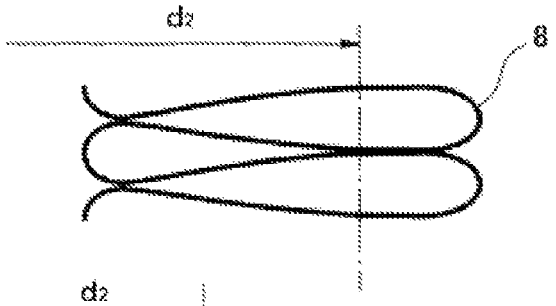
FIGS. 5A, 5B and 5C are cross sectional views of substantial parts of the other examples of the bellows.
Figure 5B:
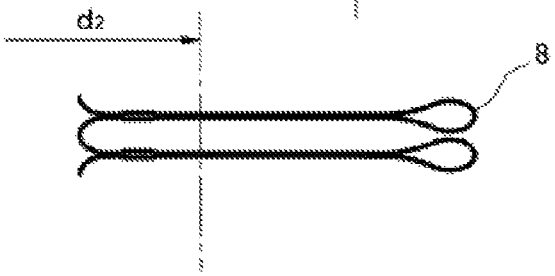
Figure 5C:
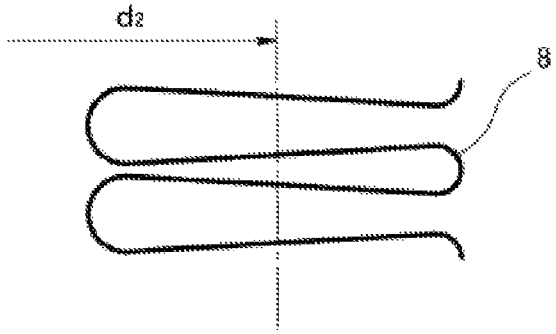

(2) In the present invention, the kind of the bellows 8 is not particularly limited, but the bellows 8 may be constructed, for example, by a bellows 8 having a U-shaped cross section as shown in FIG. 5A, a bellows 8 having a hairpin shaped cross section as shown in FIG. 5B, or a bellows 8 having a small-pitch shape (peak R<trough R) as shown in FIG. 5C. The effective diameter d2 of each of the bellows 8 is as illustrated. In any case, the seal diameter of the seal 22 (the diameter of the lip end 22*c*) is set to be equal to or larger than the effective diameter d2 of the bellows 8 (d1≥d2) or is set to be larger than the effective diameter d2 of the bellows 8 (d1>d2).

Figure 6:
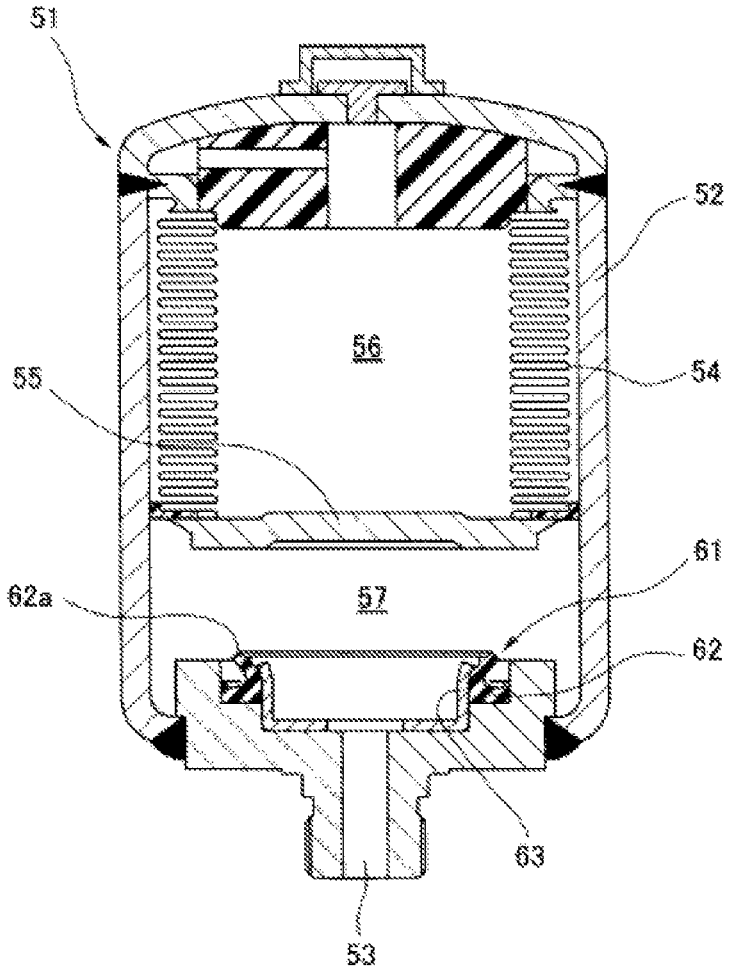
FIG. 6 is a cross sectional view of an accumulator according to a prior art.
Figure 7A:
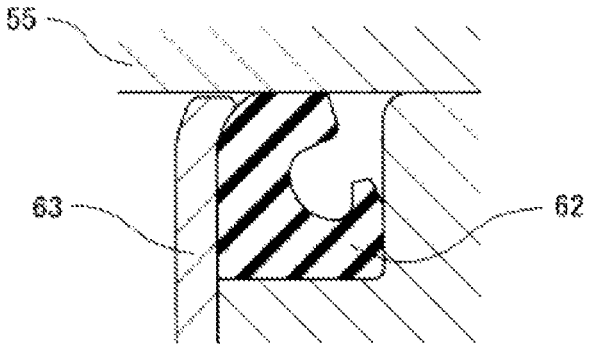
FIG. 7A is a cross sectional view showing a normal attitude of a seal.
Figure 7B:
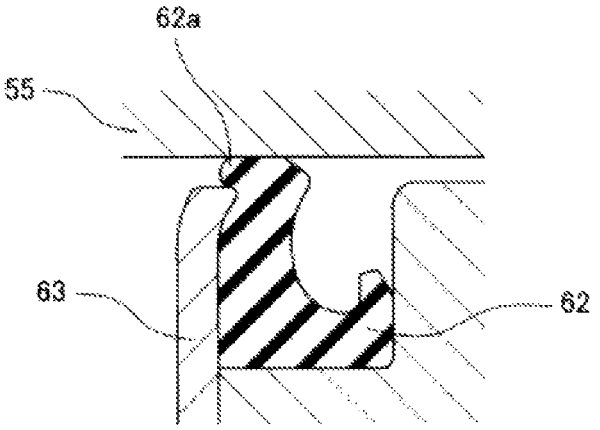
FIG. 7B is a cross sectional view of a state in which a pinching phenomenon of the seal is generated.

(3) In the embodiment, the seal retaining portion 24 arranged in the inner peripheral side of the seal 22 is integrally formed in the inner surface of the housing 2, that is, the inner surface of the oil port member 4, however, the seal retaining portion 24 may be a part which is independent from the housing 2 or the oil port member 4, for example, may be constructed by a seal holder member which is made of a sheet metal press part as shown in FIG. 6.

(4) In the embodiment mentioned above, among the inner peripheral side seal retaining portion 24 provided in the inner peripheral side of the installation groove 23 and the outer peripheral side seal retaining portion 25 provided in the outer peripheral side, the former inner peripheral side seal retaining portion 24 serves as the stopper which defines the stroke end of the bellows cap 9, however, the latter outer peripheral side seal retaining portion 25 may inversely serve as the stopper. In this case, since the height of the outer peripheral side seal retaining portion 25 is set to be larger than the height of the inner peripheral side seal retaining portion 24, the communication portion 26 is provided in the end surface portion of the outer peripheral side seal retaining portion 25 in place of the end surface portion of the inner peripheral side seal retaining portion 24.

What is claimed is:

1. An accumulator comprising:

an accumulator housing which is provided with an oil port connected to a pressure piping of equipment;

an inner portion of the accumulator housing being sectioned into a gas chamber filling with gas and a fluid chamber communicating with said oil port by a bellows and a bellows cap;

said bellows cap sealing said fluid chamber by coming into contact with a seal on the basis of movement in a stroke in the case that a pressure of said pressure piping is decreased; and said seal being retained by a seal retaining portion which is provided on an inner peripheral side of the seal, wherein said seal has only one lip end, and only said one lip end comes in contact with said bellows cap, and wherein a seal diameter of said one lip end is set to be equal to or larger than an effective diameter of said bellows at a position where said one lip end comes into contact with said bellows cap.

2. The accumulator according to claim 1, wherein said seal has a seal lip extending to said one lip end, and wherein said seal lip has a tongue shape in its cross section or a triangular shape in its cross section.

* * * * *